United States Patent [19]

Shull et al.

[11] Patent Number: 4,928,756

[45] Date of Patent: May 29, 1990

[54] HEAT DISSIPATING FIN AND METHOD FOR MAKING FIN ASSEMBLY

[75] Inventors: William Shull, Aptos; Rudolph Nissen, Pescadero; Alexander Drobshoff, Mountain View, all of Calif.

[73] Assignee: Spectra-Physics, San Jose, Calif.

[21] Appl. No.: 228,296

[22] Filed: Aug. 4, 1988

[51] Int. Cl.[5] ..... F28F 1/30

[52] U.S. Cl. ..... 165/182; 165/53

[58] Field of Search ..... 165/182, 53

[56] References Cited

U.S. PATENT DOCUMENTS

| | | | |
|---|---|---|---|
| 1,800,448 | 4/1931 | Henshall | 165/182 |
| 1,938,588 | 12/1933 | Hansen | 165/182 X |
| 2,216,778 | 10/1940 | Houdry | 165/182 |
| 2,790,628 | 4/1957 | Barnes | 165/182 X |
| 3,780,797 | 12/1973 | Gebelius | 165/55 |

*Primary Examiner*—Martin P. Schwadron
*Assistant Examiner*—Allen J. Flanigan
*Attorney, Agent, or Firm*—Lyon & Lyon

[57] ABSTRACT

A compressible heat-dissipating fin, a compressed heat-dissipating fin assembly, and a method for making a fin assembly for cooling an electromechanical device such as a transverse-flow forced air-cooled ion gas laser are disclosed. Each fin preferably has a slit running through its center except for a small hinge. The slit provides the fin with compressibility and increased contact pressure when the fin is fitted directly to and compressed against the tube, preferably by clamping, during the brazing cycle.

17 Claims, 1 Drawing Sheet

HEAT DISSIPATING FIN AND METHOD FOR MAKING FIN ASSEMBLY

BACKGROUND OF THE INVENTION

1. Field Of The Invention

The present invention relates to cooling assemblies for air-cooled electromechanical devices and in particular, methods for making such cooling assemblies for such devices.

2. The Prior Art

It is well-known that there is an optimum temperature range of operation for devices which perform work, within which the thermal efficiency of the device is highest. When the device, be it electrical, chemical, or mechanical in nature, is operated outside this optimum temperature range, its thermal efficiency falls and, especially at higher temperatures, the failure to dissipate enough heat can cause structural stresses in the device due to uneven, non-uniform temperature gradients. In the extreme case, such stresses may result in device failure.

In particular, ion gas laser performance is extremely sensitive to heat build-up and an uneven temperature distribution. Uneven temperature distribution in ion gas lasers can cause mirror instability and stress fractures in the structure of the laser tube itself, causing total failure. Therefore, there exists a need for efficient methods of heat dissipation for electromechanical devices such as ion gas lasers.

Liquid cooling is well-known in the art as one of the most effective methods of dissipating heat. However, the cost of liquid cooling can become prohibitive due to the complexity of sealing, pumping, circulating the coolant, and dissipating the heat absorbed. Air-cooling is a less expensive alternative and may be used when temperatures generated are not relatively high and the device from which the heat is to be removed can withstand a higher equilibrium operating temperature and/or the physical size of the device is relatively small.

Air-cooling can either be convection or a forced air type. Convection air-cooling relies on the still air to absorb the unwanted heat generated by the device which is then removed by convection currents. Forced air-cooling, on the other hand, is more effective because it relies on the forced movement of air past the device to be cooled to carry away unwanted heat generated by the device. The rate of heat dissipation is significantly greater than the convection air-cooling scheme, all other variables held equal.

Forced air-cooling of ion laser devices is ideally accomplished with the air blown axially along the length of the laser tube. This axial flow method has an advantage over a transverse flow system in that a uniform temperature can be maintained along a cross-section of the laser tube at operating equilibrium. If all portions of the tube around the circumference are maintained at the same temperature, mirror instability problems and tube breakage caused by non-uniform temperature gradients associated with transverse-flow forced air-cooling are prevented.

In some applications, axial-flow forced air-cooling is impractical. In such instances, transverse-flow forced air-cooling may be used almost as effectively, provided that temperature gradient of transverse air flow is dealt with effectively.

It is well known to make a heat-dissipating fin assembly for a laser by brazing transversely-oriented fins onto a metallic sleeve and, in turn, brazing the sleeve onto the ceramic bore of the laser tube. While the resulting structure has been found to be usable, it creates several problems. One problem is that stability of the laser cavity forming mirror is degraded due to differential thermal expansion during device warm-up, since the metallic sleeve to which the fins are mounted has a different coefficient of thermal expansion than does the ceramic bore which it surrounds. Another problem is that device warm-up time can be relatively lengthy because the sleeve mounting the fin represents an additional thermal mass. Therefore, there exists a need in the art for a transverse-flow forced air-cooling system for ion gas lasers which allows better heat transfer, more efficient heat dissipation, promotes a shorter warm-up time, permits a greater amount of internal power generated, and avoids or minimized mirror instability.

SUMMARY OF THE INVENTION

According to a first aspect of the invention, a compressible heat-dissipating fin is disclosed. The compressible fin of this invention is useful for cooling electromechanical devices and the like.

According to a second aspect of the invention, compressed heat-dissipating fin assemblies are disclosed, comprising a plurality of compressed heat-dissipating fins. These assemblies are useful for cooling electromechanical devices and the like, and are particular useful for cooling laser tubes.

According to a third aspect of the invention, a method is disclosed for making compressed fin assemblies for an air-cooled electromechanical device. According to this method, a plurality of compressible heat-dissipating fins are provided, adapted to fit an electromechanical device requiring heat dissipation. Then the fins are compressed against said electromechanical device. The device, along with the compressed fins, are then placed in a brazing oven. Finally, the device and plurality of fins are brazed to form a compressed fin assembly.

DETAILED DESCRIPTION OF A PREFERRED EMBODIMENT

The present invention is directed to a compressible heat-dissipating fin, a compressed heat-dissipating fin assembly, and a method for making compressed fin assemblies for cooling electromechanical devices and the like. In particular, a presently preferred embodiment of the invention may be utilized in forced air-cooled ion gas lasers in which the cooling air is blown transversely across the laser tube. According to this presently preferred embodiment, a compressible heat-dissipating fin is provided along with a method for attaching a plurality of such fins directly to an ion gas laser tube. The use of the fin and this method results in a compressed fin assembly that provides more efficient heat transfer from tube to fin, since it avoids use of an interposed sleeve, thus reducing the number of thermal barriers to heat flow. This enables the laser to provide more power with a reduced warm-up time.

A heat-dissipating fin according to the present invention is preferably made of copper and may be generally of rectangular shape with an aperture cut out of it to fit around a cylindrical laser tube. Those of ordinary skill in the art will recognize that although the aperture is described herein as being circular, it may be any shape as required to fit around the device to be cooled. The fin preferably has a slit running from its periphery to the aperture. The aperture in the fin may be defined by a flange having a lip extending axially to the aperture in a width sufficient to serve as a mechanism for spacing a plurality of fins to be assembled on the tube.

A plurality of fins may be assembled around the tube, and may then be compressed against the tube, for example by clamping. The tube and plurality of fins are then brazed while still clamped.

Figure 1:
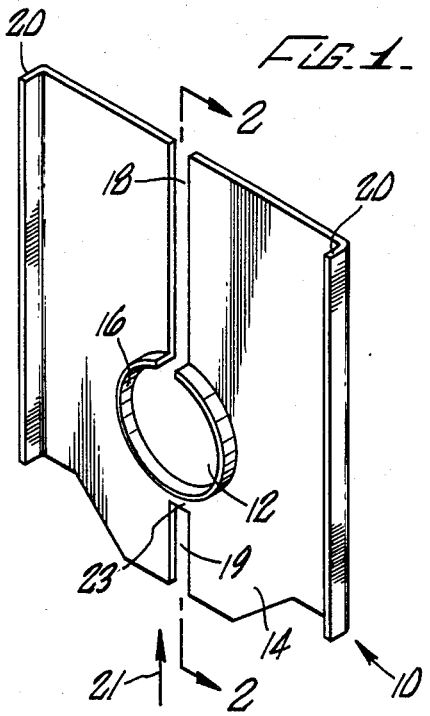
FIG. 1 is an isometric view of a heat-dissipating fin according to the present invention.

Turning now to the Figures, FIG. 1 shows a preferred embodiment of a heat dissipating fin 10 according to the present invention having a generally square or rectangular in shape, although those of ordinary skill in the art will readily recognize that other shapes are possible and are within the scope of the present invention. Fin 10 may be fabricated from a material having a high thermal conductivity, preferably a metal, such as sheet copper, by a stamping or similar process. The fabrication methods for other fin materials will readily suggest themselves to those of ordinary skill in the art.

As shown in FIG. 1, fin 10 preferably comprises a metal plate 14 having a generally circular aperture 12 defined by a central flange 16 extending in a direction parallel to the axis of the aperture 12 and thus perpendicular to the plane of fin 10. Fin 10 also has a slit 18 running from aperture 12 to its periphery. A second slit 19, substantially aligned with the first slit 18 is preferably provided extending from, but not including, flange 16, and extending through the periphery of fin 10. In such a case, a portion of flange 16 would define a hinge 23 connecting both halves of fin 10. The slit 18 or slits 18 and 19 provide means permitting the fins 10, and more specifically the flanges 16 of the fins 10, to be compressed in abutting relationship against a laser tube 22 or other electromechanical device to be cooled.

Flange 16 may also be used for the purpose of establishing spacing between a plurality of fins 10 when they are mounted as a fin assembly about a member from which heat is to be extracted, such that adjacent fins 10 are disposed in a stacked relationship to each other. Therefore, the width of flange 16 may be determined by the desired spacing between fins 10 for an assembly 30. A peripheral lip 20 may be provided on two opposing edges of fin 10. Lip 20 serves to aid in channelling forced air or connected air along an assembly of fins 10 in the direction shown by arrow 21 in FIGS. 1 and 3, and may also serve to establish spacing for fabricating a fin assembly by stacking individual fins.

Figure 2:
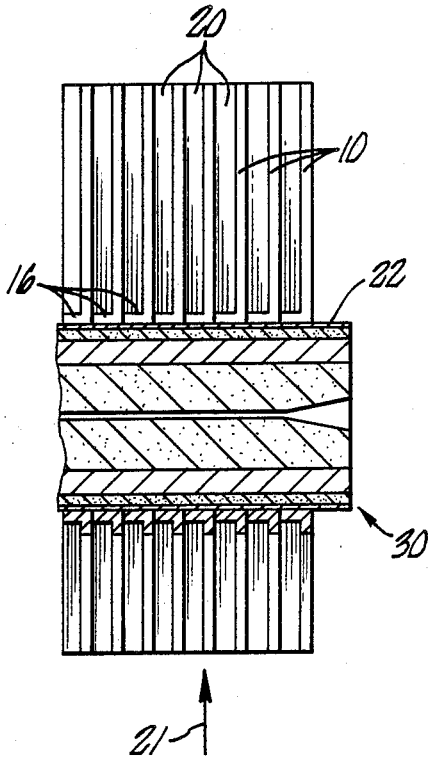
FIG. 2 is a cross-sectional plan view of an assembly including a plurality of fins mounted to a laser tube taken along the lines 2—2 of FIG. 1.
Figure 3:
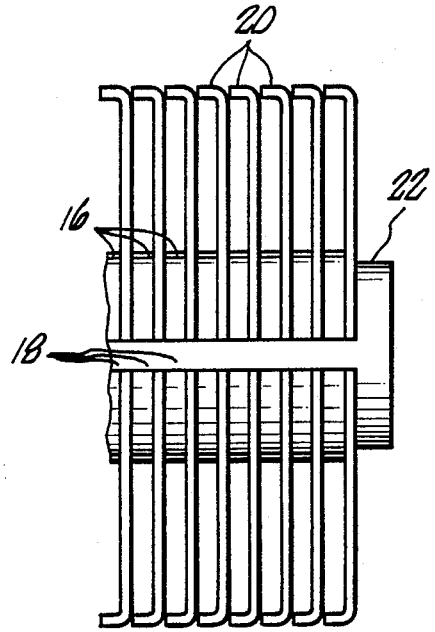
FIG. 3 is a cross-sectional top view of the an assembly including a plurality of fins of mounted to the laser tube.

A presently preferred embodiment of a fin assembly according to the present invention is set forth in FIGS. 2 and 3 in exploded cross-sectional plan and top views of the fin assembly 30 mounted to a laser tube 22.

In the embodiment of FIGS. 2 and 3, the fins 10 are made of copper and are generally rectangular in shape, although those of ordinary skill in the art will recognize that other shapes and materials can be used. Each fin 10 is placed around the laser tube 22, each fin 10 spaced apart from adjacent fins 10 by the width of its flange 16. Flange 16 of each fin 10 is adapted to fit tightly in abutting relationship to laser tube 22 when fin 10 is compressed around said tube 22, and said flange 16 provides the actual heat transfer surface area between each fin 10 and the laser tube 22. Most preferably, the flange 16 of each fin 10 fits in abutting contact to the flange 16 of adjacent fins 10 compressed around laser tube 22, providing the spacing between the body of each fin 10 in the fin assembly 30. The peripheral lip 20 on each fin 10 may also be in adjacent contact with the peripheral lips 20 of adjacent fins 10 in the fin assembly 30, helping to maintain the spacing between the plates 14 of the fins 10 in the fin assembly 30 and, whether or not in contact with adjacent fins, help direct air flow in the direction of arrow 21.

Turning to FIG. 3, it can be seen that the slit 18 of each fin 10 allows the fins to be clamped directly to the laser tube 22 prior to and during brazing, thus providing a relatively low thermal resistance from the laser tube 22 to the ambient or forced air. This structure is more thermally efficient than structures in which the fins are not attached directly to the heat-producing member, but to an intermediate member, such as a metallic sleeve, which is in turn brazed to the laser tube 22. By eliminating the need for the intermediate sleeve in the present invention, mirror stability is increased, since there are no uneven thermal stresses caused by the unequal expansion rates of laser tube 22 and a metallic intermediate sleeve surrounding it.

A plurality of fins 10 can be arranged in a stack along the length of the laser tube 22 with their slits 18 in alignment with one another. The fins 10 are then compressed around the tube 22 and then brazed or otherwise connected to the laser tube.

One method of making the above described embodiment according to the present invention consists of performing the following several steps.

First, the fins 10 are assembled onto the laser tube 22 with a 2 mil sheet of copper-silver alloy (most preferably "CuSil" eutectic alloy, which is a copper/silver eutectic alloy obtainable from GT Wesco of Belmont, Calif. or Wilkenson, Westlake Village, Calif.) interposed between the inner surface of the flanges 16 of the fins 10 and the laser tube 22 itself. For maximum heat dissipation, the fins 10 should contact each other successively at two points: their central flanges 16 and their peripheral lips 20. In addition, the fins 10 must be aligned having their lips 20 oriented in the same direction in order to facilitate a transverse air flow to dissipate the heat generated.

After the fins 10 have been stacked, they are then compressed against the laser tube 22 by applying pressure across the slit 18 of each fin. This compression can readily be carried out by using a clamp, and results in a relatively high contact pressure between the laser tube 22 and the flange lip 16 of each fin 10.

While clamped together, the fin assembly 30 and laser tube 22 are inserted into a brazing oven containing a dry hydrogen atmosphere. A brazing cycle is then begun, preferably consisting of an approximately 20 minute bake at about 750°–780° C., followed by an approximately 10 minute bake at about 800°–820° C., at which time the copper-silver alloy melts and bonds the fins 10 to the laser tube 22, followed by a cool-down to room temperature. The brazing cycle is preferably commenced at room temperature and the temperature is increased to the respective heating levels while the device is in the oven. The clamp is then removed from the fin assembly 30, leaving a cooling fin assembly 30 brazed to the laser tube 22.

Thus, a method for making a fin assembly for air-cooled ion gas lasers is disclosed which allows cooling fins to be attached positively, directly and securely to the laser tube itself, permitting maximum heat dissipation from a transverse cooling air flow and eliminating mirror instability. While embodiments and applications of this invention have been shown and described, it would be apparent to those skilled in the art that many more modifications are possible without departing from the inventive concepts herein. For example, while a copper fin is suitable for brazing with copper-silver alloy to an $Al_2O_3$ laser tube, it will be apparent to one of ordinary skill that different materials will be suitable depending upon the nature of the electromechanical device to be cooled. It will be understood that the brazing cycle can also vary, and will be selected such that the brazing alloy will melt to form a secure bond, but will not be permitted to run excessively. Likewise, as has been noted above, the shape of the fins can be varied, as well as other details of their construction and the manner in which they can be designed such that they are adapted to be compressed in abutting relationship against an electromechanical device to be cooled. Accordingly, the invention is not intended to be restricted to the preferred embodiments disclosed herein, but rather is intended to be construed in accordance with the appended claims and equivalents thereto.

What is claimed is:

1. A compressible heat-dissipating fin, attached to a tube, comprising a metal plate having a flange and a peripheral edge, said flange defining an aperture adapted to compress against the tube, said peripheral edge of the plate defining a pair of opposed substantially parallel lips, and wherein the plate, the pair of lips, and the flange are formed from a single piece of metal, said plate further comprising a first slit defined by the plate and extending from the aperture to the peripheral edge of the plate and a second slit defined by the plate and extending from the flange to the peripheral edge of the plate, and wherein the compressible heat-dissipating fin is attached to the tube by means other than welding.

2. A compressible heat-dissipating fin assembly attached to a tube, comprising a plurality of heat-dissipating fins, each fin having a metal plate having a flange and a peripheral edge, said flange defining an aperture adapted to compress against the tube, said peripheral edge of the plate defining a pair of opposed substantially parallel lips, and wherein the plate, the pair of lips, and the flange are formed from a single piece of metal, said plate further comprising a first slit defined by the plate and extending from the aperture to the peripheral edge of the plate and a second slit defined by the plate and extending from the flange to the peripheral edge of the plate, and wherein each compressible heat-dissipating fin is attached to the tube by means other than welding.

3. The fin of claim 1 wherein the tube to which it is attached is a laser tube.

4. The fin of claim 3 wherein the metal fin comprises copper metal.

5. The fin of claim 4 wherein the metal consists essentially of copper.

6. The fin of claim 5 wherein the second slit is disposed substantially in alignment with the first slit.

7. The fin of claim 6 wherein the plate is of substantially rectangular shape.

8. The fin of claim 7, wherein the fin is in an abutting relationship to at least one other like fin.

9. The fin of claim 8, wherein the fin is one of a series of three or more like fins.

10. The fin of claim 9, wherein each fin in the series is connected to the tube with copper-silver alloy.

11. The compressible heat dissipating fin assembly of claim 2 wherein the tube to which the assembly is attached is a laser tube.

12. The assembly of claim 11 wherein each fin in the assembly is in an abutting relationship to at least one other like fin.

13. The assembly of claim 12 wherein each fin comprises copper metal.

14. The assembly of claim 13 wherein each fin consists essentially of copper metal.

15. The assembly of claim 14 wherein each fin is connected to the tube with copper-silver alloy.

16. The assembly of claim 15 wherein each fin has the second slit disposed substantially in alignment with the first slit.

17. The assembly of claim 16 wherein each fin is substantially rectangular in shape.

* * * * *